US008664508B2

(12) United States Patent
Tabata

(10) Patent No.: US 8,664,508 B2
(45) Date of Patent: Mar. 4, 2014

(54) MUSICAL PERFORMANCE DEVICE, METHOD FOR CONTROLLING MUSICAL PERFORMANCE DEVICE AND PROGRAM STORAGE MEDIUM

(71) Applicant: Casio Computer Co., Ltd., Tokyo (JP)

(72) Inventor: Yuji Tabata, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/754,288

(22) Filed: Jan. 30, 2013

(65) Prior Publication Data

US 2013/0239780 A1 Sep. 19, 2013

(30) Foreign Application Priority Data

Mar. 14, 2012 (JP) ..... 2012-057967

(51) Int. Cl.
*G10H 3/00* (2006.01)

(52) U.S. Cl.
USPC ..... 84/723

(58) Field of Classification Search
USPC ..... 84/723
See application file for complete search history.

(56) References Cited

U.S. PATENT DOCUMENTS

| | | | |
|---|---|---|---|
| 4,341,140 | A | 7/1982 | Ishida |
| 4,968,877 | A | 11/1990 | McAvinney et al. |
| 5,017,770 | A | 5/1991 | Sigalov |
| 5,081,896 | A | 1/1992 | Hiyoshi et al. |
| 5,369,270 | A | 11/1994 | Gurner et al. |
| 5,414,256 | A | 5/1995 | Gurner et al. |
| 5,442,168 | A | 8/1995 | Gurner et al. |
| 5,475,214 | A | 12/1995 | DeFranco et al. |
| 6,028,594 | A | 2/2000 | Inoue |
| 6,222,465 | B1 | 4/2001 | Kumar et al. |
| RE37,654 | E | 4/2002 | Longo |
| 6,388,183 | B1 | 5/2002 | Leh |

(Continued)

FOREIGN PATENT DOCUMENTS

| | | | |
|---|---|---|---|
| JP | 06-301476 | A | 10/1994 |
| JP | 3599115 | B2 | 12/2004 |

OTHER PUBLICATIONS

U.S. Appl. No. 13/797,725; First Named Inventor: Yuji Tabata ; Title: "Musical Performance Device, Method for Controlling Musical Performance Device and Program Storage Medium"; Filed: Mar. 12, 2013.

(Continued)

*Primary Examiner* — Jeffrey Donels
(74) *Attorney, Agent, or Firm* — Holtz, Holtz, Goodman & Chick

(57) ABSTRACT

An object of the present invention is to provide a musical performance device by which the arrangement of a virtual musical instrument set is suitably changed based on the position of the instrument player, and whereby the instrument player need not play in an uncomfortable position. In the present invention, set layout information includes standard set layout information that serves as reference for the arrangement of a plurality of virtual pads, and a CPU judges whether an operation to form a square has been performed with a pair of drumstick sections. When judged that this operation has been performed, the CPU uniformly adjusts the arrangement of the virtual pads based on preset position coordinates on a captured image plane corresponding to the standard set layout information and the position coordinates of the drumstick sections on the captured image plane at the time of the operation to form a square.

6 Claims, 13 Drawing Sheets

(56) References Cited

U.S. PATENT DOCUMENTS

| | | | | |
|---|---|---|---|---|
| 6,492,775 | B2 | 12/2002 | Klotz et al. | |
| 6,960,715 | B2 | 11/2005 | Riopelle | |
| 7,402,743 | B2 | 7/2008 | Clark et al. | |
| 7,504,577 | B2 * | 3/2009 | Riopelle | 84/723 |
| 7,723,604 | B2 | 5/2010 | Bang et al. | |
| 7,799,984 | B2 | 9/2010 | Salter | |
| 8,198,526 | B2 * | 6/2012 | Izen et al. | 84/743 |
| 8,445,769 | B2 * | 5/2013 | Takahashi | 84/737 |
| 8,445,771 | B2 * | 5/2013 | Sakazaki | 84/743 |
| 8,477,111 | B2 | 7/2013 | Lim | |
| 2001/0035087 | A1 | 11/2001 | Sobotnick | |
| 2003/0159567 | A1 | 8/2003 | Subotnick | |
| 2006/0084218 | A1 * | 4/2006 | Lee et al. | 438/201 |
| 2006/0174756 | A1 * | 8/2006 | Pangrle | 84/724 |
| 2007/0000374 | A1 | 1/2007 | Clark et al. | |
| 2007/0256546 | A1 | 11/2007 | Hikino et al. | |
| 2007/0265104 | A1 * | 11/2007 | Haga et al. | 473/37 |
| 2008/0318677 | A1 * | 12/2008 | Ohta | 463/36 |
| 2009/0318225 | A1 | 12/2009 | Yamaguchi et al. | |
| 2010/0009746 | A1 * | 1/2010 | Raymond et al. | 463/31 |
| 2012/0137858 | A1 * | 6/2012 | Sakazaki | 84/723 |
| 2012/0144979 | A1 | 6/2012 | Tansley | |
| 2012/0152087 | A1 * | 6/2012 | Sakazaki | 84/600 |
| 2013/0118339 | A1 * | 5/2013 | Lee et al. | 84/725 |

OTHER PUBLICATIONS

U.S. Appl. No. 13/754,323; First Named Inventor: Yuji Tabata ; Title: "Musical Performance Device, Method for Controlling Musical Performance Device and Program Storage Medium"; Filed: Jan. 30, 2013.

* cited by examiner

MUSICAL PERFORMANCE DEVICE, METHOD FOR CONTROLLING MUSICAL PERFORMANCE DEVICE AND PROGRAM STORAGE MEDIUM

CROSS-REFERENCE TO RELATED APPLICATION

This application is based upon and claims the benefit of priority from the prior Japanese Patent Application No. 2012-057967, filed Mar. 14, 2012, the entire contents of which is incorporated herein by reference.

BACKGROUND OF THE INVENTION

1. Field of the Invention

The present invention relates to a musical performance device, a method for controlling a musical performance device and a program storage medium.

2. Description of the Related Art

Conventionally, a musical performance device has been proposed which, when a playing movement by an instrument player is detected, generates an electronic sound in response to it. For example, a musical performance device (air drums) is known that generates a percussion instrument sound using only components provided on drumsticks. In this musical performance device, when the instrument player makes a playing movement which is similar to the motion of striking a drum and in which the instrument player holds drumstick-shaped components with a built-in sensor and swings them, the sensor detects the playing movement and a percussion instrument sound is generated.

In this type of musical performance device, the sound of a musical instrument can be emitted without the actual musical instrument. Therefore, the instrument player can enjoy playing music without the limitations of a playing location or a playing space.

As this type of musical performance device, for example, Japanese Patent No. 3599115 discloses a musical instrument gaming device that captures an image of a playing movement made by the instrument player using drumstick-shaped components, displays on a monitor a composite image generated by the captured image of the playing movement and a virtual image showing a musical instrument set being combined, and emits a predetermined musical sound based on the positional information of the drumstick-shaped components and the virtual musical instrument set.

However, in the musical instrument gaming device disclosed in Japanese Patent No. 3599115, layout information, such as information regarding the arrangement of the virtual musical instrument set, has been predetermined. Therefore, if this musical instrument gaming device is used as is, the arrangement of the virtual musical instrument set remains unchanged even after the instrument player repositions him or herself. As a result, the instrument player is forced to play in an uncomfortable position.

SUMMARY OF THE INVENTION

The present invention has been conceived in light of the above-described problems. An object of the present invention is to provide a musical performance device, a method for controlling a musical performance device, and a program storage medium by which, when an instrument player repositions him or herself, the arrangement of the virtual musical instrument set is changed based on the position of the instrument player, whereby the instrument player need not play in an uncomfortable position.

In order to achieve the above-described object, in accordance with one aspect of the present invention, there is provided a musical performance device comprising: a musical performance component which is operated by a player; a position detecting section which detects position of the musical performance component on a virtual plane where the musical performance component is operated; a storage section which stores layout information including positions of a plurality of areas arranged on the virtual plane and musical tones respectively associated with the plurality of areas; a predetermined operation judging section which judges whether a predetermined operation is performed on the musical performance component; a changing section which similarly changes the respective positions of the plurality of areas in the layout information stored in the storage section based on the position of the musical performance component at time of the predetermined operation, when the predetermined operation is judged to be performed; a judging section which judges whether the position of the musical performance component is within any one of the plurality of areas arranged based on the layout information stored in the storage section, when a certain music-playing operation is performed by the musical performance component; and a sound generation instructing section which, when the judging section judges that the position of the musical performance component is within one area of the plurality of areas, gives an instruction to emit musical sound of a musical tone associated with the one area.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of the present invention will hereinafter be described with reference to the drawings.

[Overview of the Musical Performance Device 1]

First, an overview of the musical performance device 1 according to the embodiment of the present invention will be described with reference to FIG. 1A and FIG. 1B.

Figure 1A:
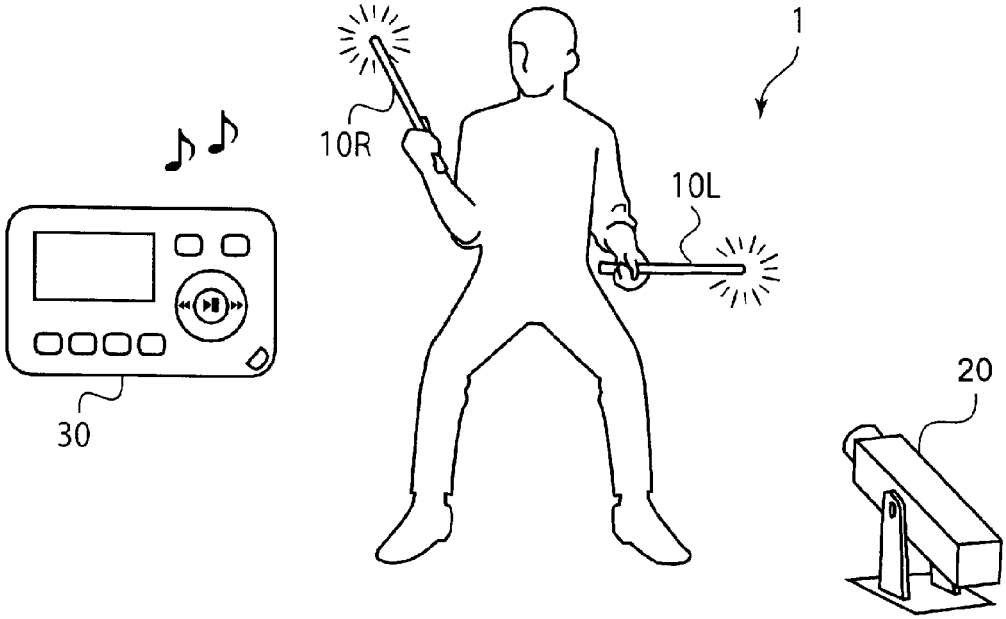
FIG. 1A and FIG. 1B are diagrams outlining a musical performance device according to an embodiment of the present invention.
Figure 1B:
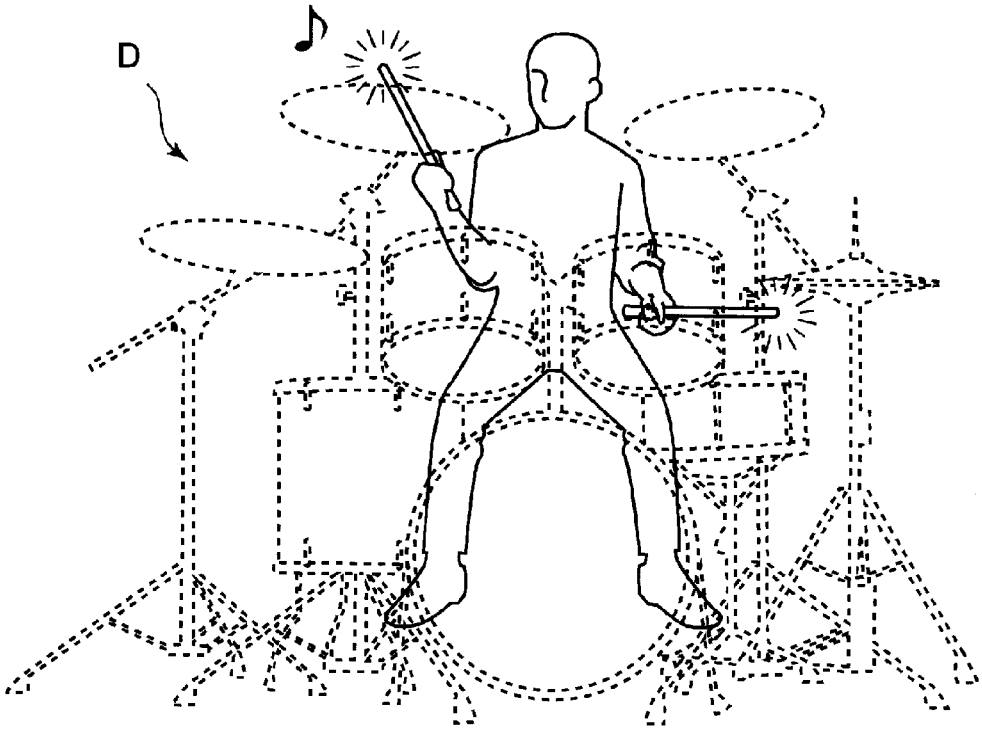

The musical performance device 1 according to the present embodiment includes drumstick sections 10R and 10L, a camera unit section 20, and a center unit section 30, as shown in FIG. 1A. Note that, although this musical performance device 1 includes two drumstick sections 10R and 10L to actualize a virtual drum performance by two drumsticks, the number of drumstick sections is not limited thereto, and the musical performance device 1 may include a single drumstick section, or three or more drumstick sections. In the following descriptions where the drumstick sections 10R and 10L are not required to be differentiated, these two drumstick sections 10R and 10L are collectively referred to as "drumstick section 10".

The drumstick section 10 is a drumstick-shaped musical performance component that extends in a longitudinal direction. The instrument player holds one end (base end side) of the drumstick section 10 and makes, as a playing movement, a movement in which the drumstick section 10 is swung upwards and downwards with his or her wrist or the like as a fulcrum. In the other end (tip end side) of the drumstick section 10, various sensors such as an acceleration sensor and an angular velocity sensor (motion sensor section 14, described hereafter) are provided to detect this playing movement by the instrument player. The drumstick section 10 transmits a note-ON event to the center unit section 30 based on a playing movement detected by these various sensors.

Also, on the tip end side of the drumstick section 10, a marker section 15 (see FIG. 2) described hereafter is provided so that the camera unit section 20 can recognize the tip of the drumstick section 10 during imaging.

The camera unit section 20 is structured as an optical imaging device. This camera unit section 20 captures a space including an instrument player who is making a playing movement with the drumstick section 10 in hand (hereinafter referred to as "imaging space") as a photographic subject at a predetermined frame rate, and outputs the captured images as moving image data. Then, it identifies the position coordinates of the marker section 15 emitting light within the imaging space, and transmits data indicating the position coordinates (hereinafter referred to as "position coordinate data") to the center unit section 30.

The center unit section 30 emits, when a note-ON event is received from the drumstick section 10, a predetermined musical sound based on the position coordinate data of the marker 15 at the time of the reception of this note-ON event. Specifically, the position coordinate data of a virtual drum set D shown in FIG. 1B has been stored in the center unit section 30 in association with the imaging space of the camera unit section 20, and the center unit section 30 identifies a musical instrument virtually struck by the drumstick section 10 based on the position coordinate data of the virtual drum set D and the position coordinate data of the marker section 15 at the time of the reception of a note-ON event, and emits a musical sound corresponding to the musical instrument.

Next, the structure of the musical performance device 1 according to the present embodiment will be described in detail.

[Structure of the Musical Performance Device 1]

First, the structure of each components of the musical performance device 1 according to the present embodiment, or more specifically, the structures of the drumstick section 10, the camera unit section 20, and the center unit section 30 will be described with reference to FIG. 2 to FIG. 5.

[Structure of the Drumstick Section 10]

Figure 2:
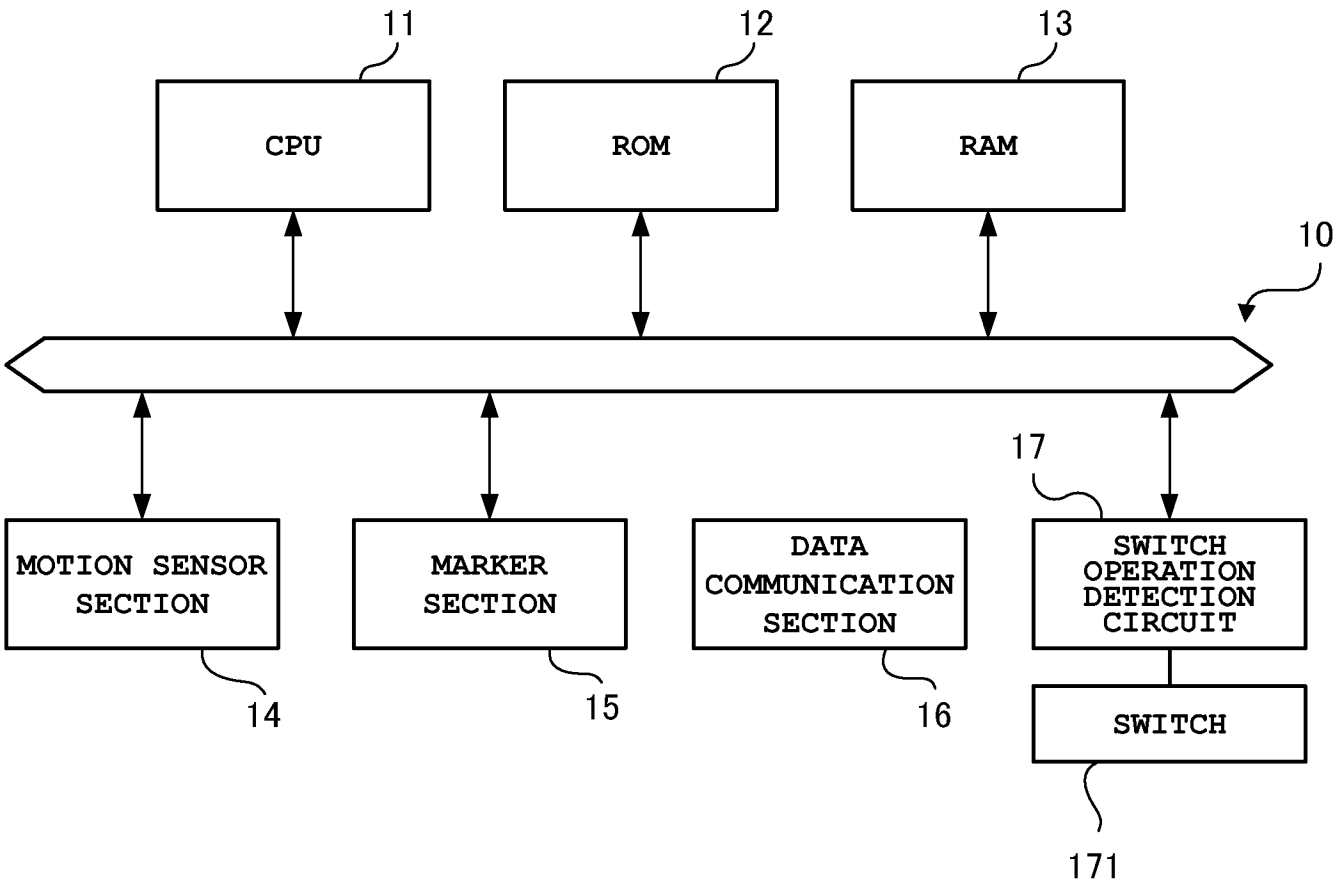
FIG. 2 is a block diagram showing the hardware structure of a drumstick section constituting the musical performance device.

FIG. 2 is a block diagram showing the hardware structure of the drumstick section 10.

The drumstick section 10 includes a Central Processing Unit (CPU) 11, a Read-Only Memory (ROM) 12, a Random Access Memory (RAM) 13, the motion sensor section 14, the marker section 15, a data communication section 16, and a switch operation detection circuit 17, as shown in FIG. 2.

The CPU 11 controls the entire drumstick section 10. For example, the CPU 11 performs the detection of the attitude of the drumstick section 10, shot detection, and action detection based on sensor values outputted from the motion sensor section 14. Also, the CPU 11 controls light-ON and light-OFF of the marker section 15. Specifically, the CPU 11 reads out marker characteristics information from the ROM 12 and performs light emission control of the marker section 15 in accordance with the marker characteristics information. Moreover, the CPU 11 controls communication with the center unit section 30, via the data communication section 16.

The ROM 12 stores processing programs that enable the CPU 11 to perform various processing and marker characteristics information that is used for light emission control of the marker section 15. Here, the camera unit section 20 is required to differentiate between the marker section 15 of the drumstick section 10R (hereinafter referred to as "first marker" when necessary) and the marker section 15 of the drumstick section 10L (hereinafter referred to as "second marker" when necessary). The marker characteristics information is information enabling the camera unit section 20 to differentiate between the first marker and the second marker. For example, shape, size, hue, saturation, luminance during light emission, or flashing speed during light emission may be used as the marker characteristics information.

The CPU 11 of the drumstick section 10R and the CPU 11 of the drumstick section 10L each read out different marker characteristics information and perform light emission control of the respective marker sections 15.

The RAM 13 stores values acquired or generated during processing, such as various sensor values outputted by the motion sensor section 14.

The motion sensor section 14 includes various sensors for detecting the status of the drumstick section 10, and outputs predetermined sensor values. Here, the sensors constituting the motion sensor section 14 are, for example, an acceleration sensor, an angular velocity sensor, and a magnetic sensor.

Figure 3:
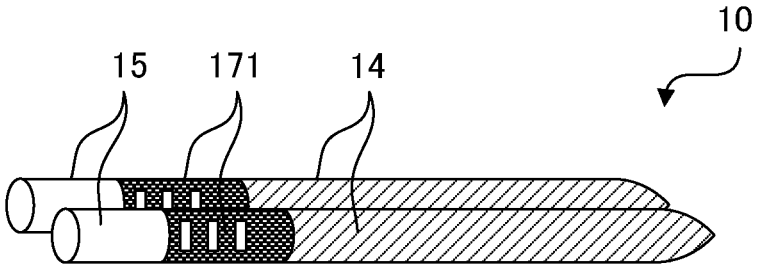
FIG. 3 is a perspective view of the drumstick section.

FIG. 3 is a perspective view of the drumstick section 10, in which a switch section 171 and the marker section 15 have been externally arranged on the drumstick section 10.

The instrument player moves the drumstick section 10 by holding one end (base end side) of the drumstick section 10 and swinging the drumstick section 10 upwards and downwards with the wrist or the like as a fulcrum, during which sensor values based on this movement are outputted from the motion sensor section 14.

When the sensor values are received from the motion sensor section 14, the CPU 11 detects the status of the drumstick section 10 that is being held by the instrument player. For example, the CPU 11 detects timing at which the drumstick section 10 strikes the virtual musical instrument (hereinafter also referred to as "shot timing"). The shot timing denotes a time immediately before the drumstick section 10 is stopped after being swung downwards, at which the acceleration of the drumstick section 10 in the direction opposite to the downward swing direction exceeds a certain threshold value.

Also, the sensor values of the motion sensor section 14 include data required to detect a "pitch angle" that is an angle formed by a longitudinal direction when the player holds the stick section 10 and a horizontal plane.

Returning to FIG. 2, the marker section 15 is a light-emitting body provided on the tip end side of the drumstick section 10, which is constituted by, for example, a light emitting diode (LED). This marker section 15 is turned ON and OFF under the control of the CPU 11. Specifically, this marker section 15 is lit based on marker characteristics information read out from the ROM 12 by the CPU 11. At this time, the marker characteristics information of the drumstick section 10R and the marker characteristics information of the drumstick section 10L differ, and therefore the camera unit section 20 can differentiate them and individually acquire the position coordinates of the marker section (first marker) 15 of the drumstick section 10R and the position coordinates of the marker section (second marker) 15 of the drumstick section 10L.

The data communication section 16 performs predetermined wireless communication with at least the center unit section 30. This predetermined wireless communication can be performed by an arbitrary method. In the present embodiment, wireless communication with the center unit section 30 is performed by infrared data communication. Note that the data communication section 16 may perform wireless communication with the camera unit section 20, or may perform wireless communication between the drumstick section 10R and the drumstick section 10L.

The switch operation detection circuit 17 is connected to the switch 171 and receives input information via the switch 171. This input information includes, for example, a set layout change signal that serves as a trigger to change set layout information, described hereafter.

[Structure of the Camera Unit Section 20]

The structure of the drumstick section 10 is as described above. Next, the structure of the camera unit section 20 will be described with reference to FIG. 4.

Figure 4:
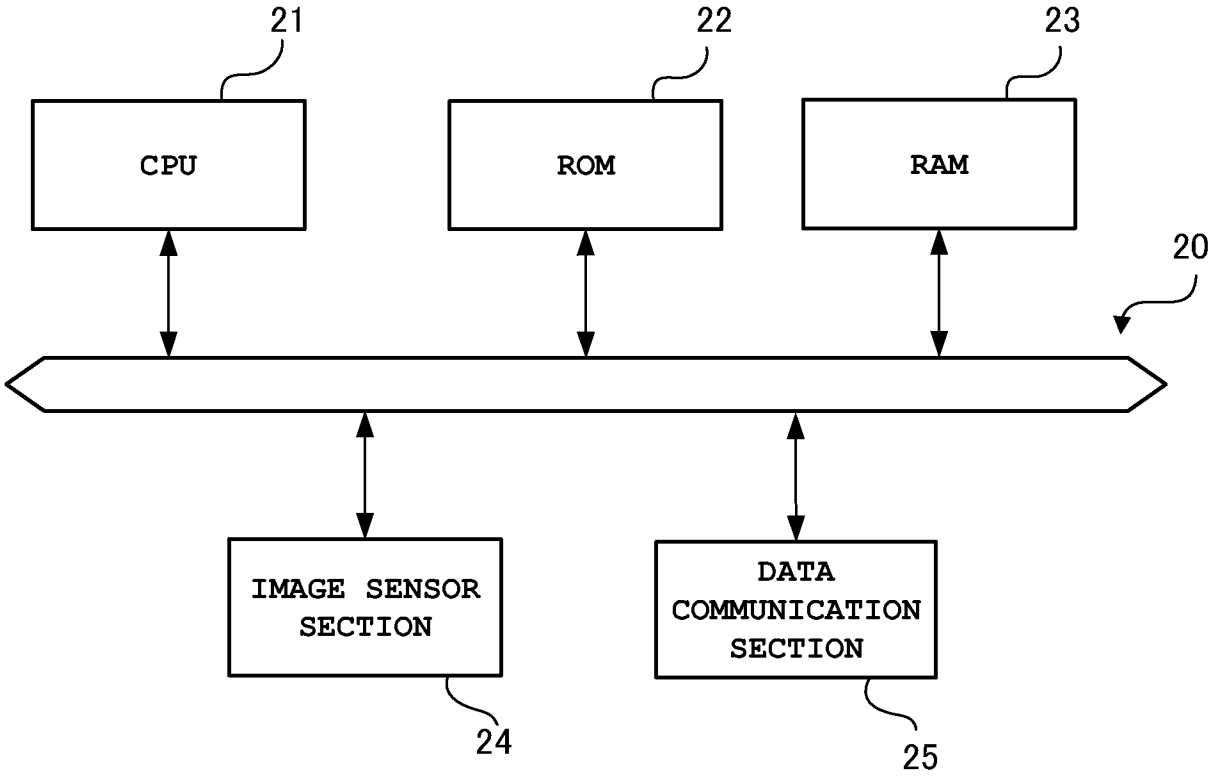
FIG. 4 is a block diagram showing the hardware structure of a camera unit section constituting the musical performance device.

FIG. 4 is a block diagram showing the hardware structure of the camera unit section 20.

The camera unit section 20 includes a CPU 21, a ROM 22, a RAM 23, an image sensor section 24, and a data communication section 25.

The CPU 21 controls the entire camera unit section 20. For example, the CPU 21 controls to calculate the respective position coordinates of the marker sections 15 (first marker and second marker) of the drumstick sections 10R and 10L based on the position coordinate data and the marker characteristics information of the marker sections 15 detected by the image sensor section 24, and output position coordinate data indicating each calculation result. Also, the CPU 21 controls communication to transmit calculated position coordinate data and the like to the center unit section 30, via the data communication section 25.

The ROM 22 stores processing programs enabling the CPU 21 to perform various processing, and the RAM 23 stores values acquired or generated during processing, such as the position coordinate data of the marker section 15 detected by the image sensor section 24. The RAM 23 also stores the respective marker characteristics information of the drumstick sections 10R and 10L received from the center unit section 30.

The image sensor section 24 is, for example, an optical camera, and captures a moving image of the instrument player who is performing a playing movement with the drumstick section 10 in hand, at a predetermined frame rate. In addition, the image sensor section 24 outputs captured image data to the CPU 21 per frame. Note that the identification of the position coordinates of the marker section 15 of the drumstick section 10 within a captured image may be performed by the image sensor section 24, or it may be performed by the CPU 21. Similarly, the identification of the marker characteristics information of the captured marker section 15 may he performed by the image sensor section 24, or it may be performed by the CPU 21.

The data communication section 25 performs predetermined wireless communication (such as infrared data communication) with at least the center unit section 30. Note that the data communication section 25 may perform wireless communication with the drumstick section 10.

[Structure of the Center Unit Section 30]

The structure of the camera unit section 20 is as described above, Next, the structure of the center unit section 30 will be described with reference to FIG. 5.

Figure 5:
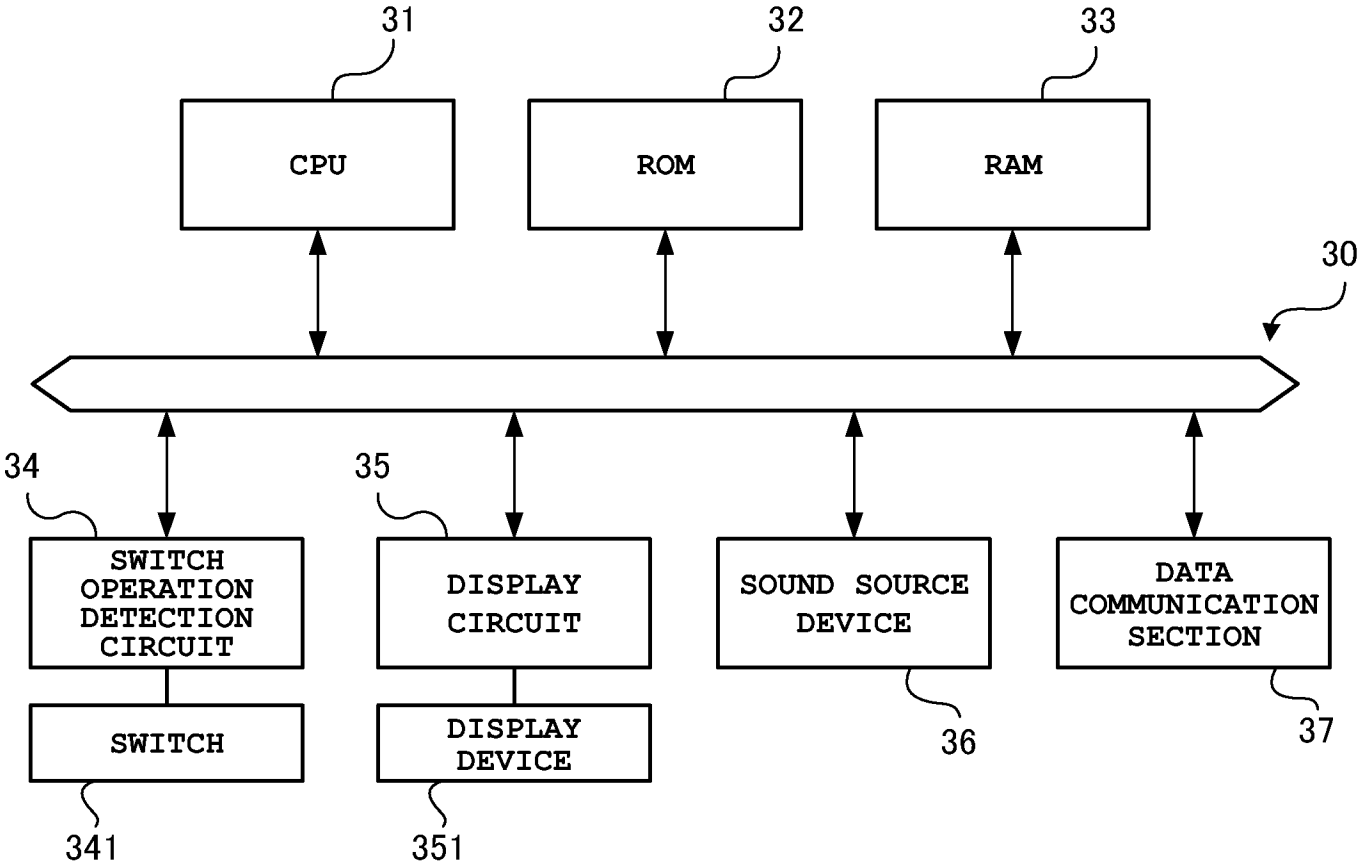
FIG. 5 is a block diagram showing the hardware structure of a center unit section constituting the musical performance device.

FIG. 5 is a block diagram showing the hardware structure of the center unit section 30.

The center unit section 30 includes a CPU 31, a ROM 32, a RAM 33, a switch operation detection circuit 34, a display circuit 35, a sound source device 36, and a data communication section 37.

The CPU 31 controls the entire center unit section 30. For example, the CPU 31 controls to emit a predetermined musical sound or the like based on a shot detection result received from the drumstick section 10 and the position coordinates of the marker section 15 received from the camera unit section 20. Also, the CPU 31 controls communication between the drumstick section 10 and the camera unit section 20, via the data communication section 37.

The ROM 32 stores processing programs for various processing that are performed by the CPU 31. In addition, the ROM 32 stores waveform data of various musical tones, such as waveform data (musical tone data) of wind instruments like the flute, saxophone, and trumpet, keyboard instruments like the piano, string instruments like the guitar, and percussion instruments like the bass drum, high-hat, snare drum, cymbal, and tom-tom, in association with position coordinates.

Figure 6:
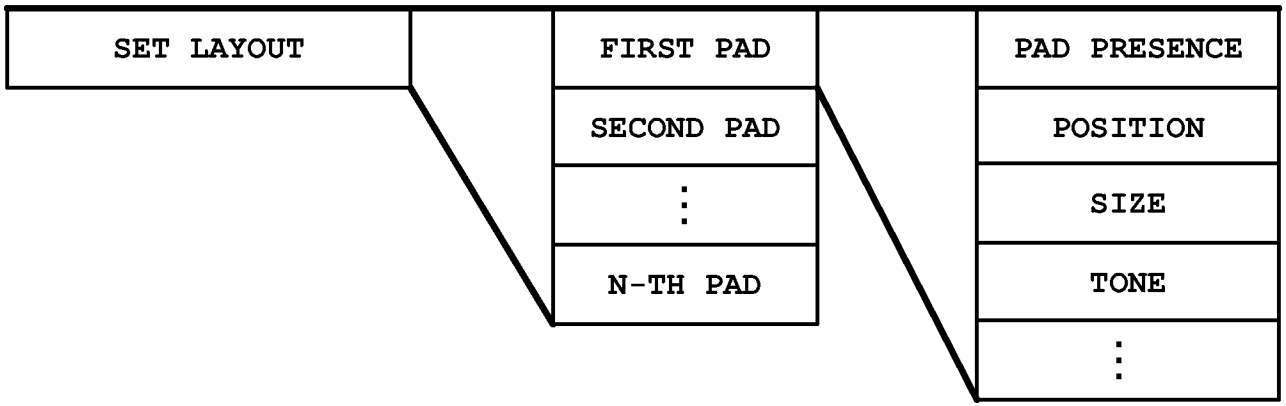
FIG. 6 is a diagram showing set layout information of the musical performance device according to the embodiment of the present invention.

In a method for storing these musical tone data, set layout information includes n-pieces of pad information for first to n-th pads, as shown in FIG. 6. In addition, the presence of a pad (the presence of a virtual pad on a virtual plane described hereafter), the position (position coordinates on the virtual plane described hereafter), the size (shape, diameter, and the like of the virtual pad) the musical tone (waveform data) and the like are stored in association with each piece of pad information.

Figure 7:
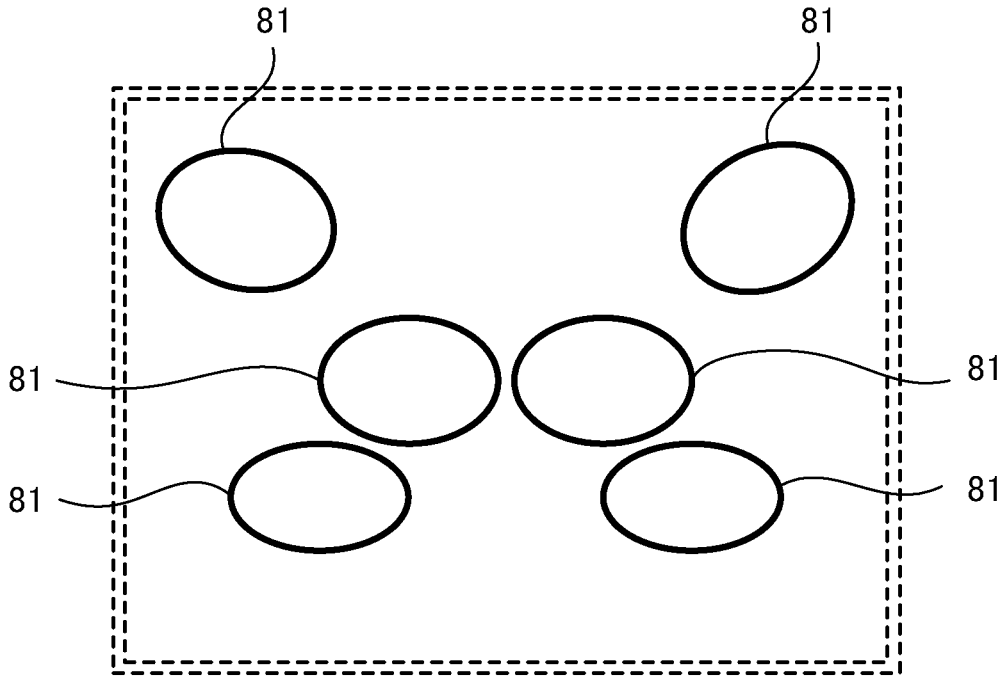
FIG. 7 is a diagram showing a concept indicated by the set layout information, in which the concept has been visualized on a virtual plane.

Here, a specific set layout will be described with reference to FIG. 7. FIG. 7 is a diagram showing a concept indicated by set layout information (see FIG. 6) stored in the ROM 32 of the center unit section 30, in which the concept has been visualized on a virtual plane.

In FIG. 7, six virtual pads 81 have been arranged on a virtual plane These virtual pads 81 correspond to, among the first to n-th pads, pads whose pad presence data indicates "pad present". For example, six pads, which are a second pad, a third pad, a fifth pad, a sixth pad, an eighth pad, and a ninth pad, correspond to the virtual pads 81. Also, these virtual pads 81 have been arranged based on positional data and size data, and each of which has been associated with musical tone data. Therefore, when the position coordinates of the marker section 15 at the time of shot detection are within an area corresponding to a virtual pad 81, the musical tone associated with the virtual pad 81 is emitted.

Note that the CPU 31 may display this virtual plane and the arrangement of the virtual pads 81 on a display device 351 described hereafter. Also note that set layout information stored in the ROM 32 is hereinafter referred to as "standard set layout information", and a position and a size included in the standard set layout information are hereinafter referred to as "standard position" and "standard size".

Figure 11:
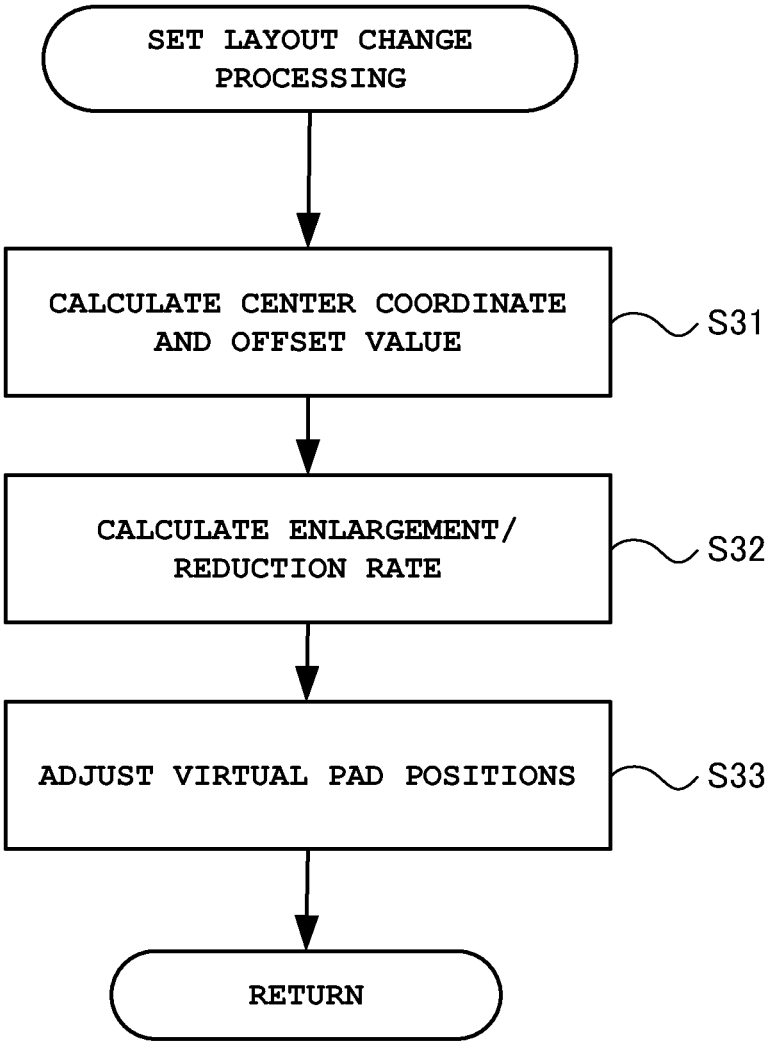
FIG. 11 is a flowchart of set layout change processing by the center unit section.

The standard position and the standard size included in the standard set layout information are uniformly changed by set layout change processing described hereafter with reference to FIG. 11.

Returning to FIG. 5, the RAM 33 stores values acquired or generated during processing, such as the status of the drumstick section 10 received from the drumstick section 10 (such as shot detection), the position coordinates of the marker section 15 received from the camera unit section 20, and standard set layout information read out from the ROM 32.

The CPU 31 read out musical tone data (waveform data) associated with a virtual pad 81 in an area where the position coordinates of the marker section 15 are located at the time of shot detection (or in other words, when a note-ON event is received), from set layout information stored in the RAM 33. As a result, a musical sound based on a playing movement by the instrument player is emitted.

The switch operation detection circuit 34 is connected to a switch 341 and receives input information via the switch 341. The input information includes, for example, information regarding changes in the sound volume and the musical tone of a musical sound to be emitted, information regarding the setting and change of a set layout number, and information regarding switching of display by the display device 351.

The display circuit 35 is connected to the display device 351 and performs display control for the display device 351.

The sound source device 36 reads out waveform data from the ROM 32 in accordance with an instruction from the CPU 31, and after generating musical sound data, converts it to an analog signal, and emits the musical sound from a speaker (not shown).

The data communication section 37 performs predetermined wireless communication (such as infrared data communication) between the drumstick section 10 and the camera unit section 20.

[Processing by the Musical Performance Device 1]

The structures of the drumstick section 10, the camera unit section 20, and the center unit section 30 constituting the musical performance device 1 are as described above. Next, processing by the musical performance device 1 will be described with reference to FIG. 8 to FIG. 11.

[Processing by the Drumstick Section 10]

Figure 8:
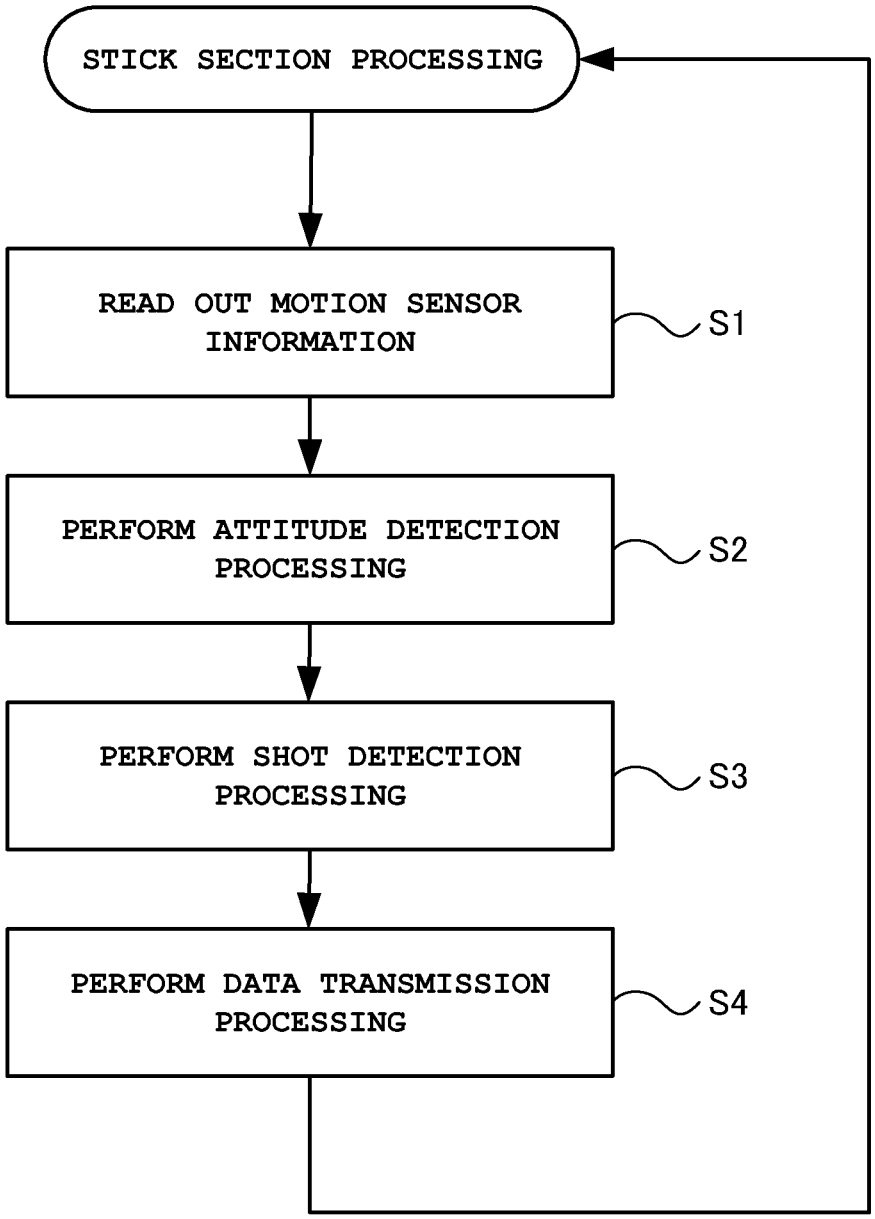
FIG. 8 is a flowchart of processing by the drumstick section.

FIG. 8 is a flowchart of processing that is performed by the drumstick section 10 (hereinafter referred to as "drumstick section processing").

As shown in FIG. 8, the CPU 11 of the drumstick section 10 first reads out motion sensor information from the motion sensor section 14, or in other words, the CPU 11 of the drumstick section 10 reads out sensor values outputted by the various sensors, and stores the sensor values in the RAM 13 (Step S1). Subsequently, the CPU 11 performs attitude detection processing for the drumstick section 10 based on the read out motion sensor information (Step S2). In the attitude detection processing, the CPU 11 calculates the attitude of the drumstick section 10, such as the roll angle and the pitch angle of the stick section 10, based on the motion sensor information.

Then, the CPU 11 performs shot detection processing based on the motion sensor information (Step S3). Here, when playing music using the drumstick section 10, the instrument player generally performs a playing movement that is similar to the motion of striking an actual musical instrument (such as a drum). In this playing movement the instrument player first swings the drumstick section 10 upwards, and then swings it downward toward the virtual musical instrument. Subsequently, the instrument player applies force to stop the movement of the drumstick section 10 immediately before the drumstick section 10 strikes the virtual musical instrument. At this time, the instrument player is expecting the musical sound to be emitted at the instant the drumstick section 10 strikes the virtual musical instrument. Therefore, it is preferable that the musical sound is emitted at timing expected by the instrument player. Accordingly, in the present embodiment a musical sound is emitted at the instant the surface of the virtual musical instrument is struck by the instrument player with the drumstick section 10, or at timing slightly prior thereto.

In the present embodiment, the timing of shot detection denotes a time immediately before the drumstick section 10 stops after being swung downwards, at which the acceleration of the drumstick section 10 in the direction opposite to the downward swing direction exceeds a certain threshold value.

When judged that the shot detection timing serving as a sound generation timing has come, the CPU 11 of the drumstick section 10 generates a note-ON event and transmits it to the center unit section 30. As a result, sound emission processing is performed by the center unit section 30 and the musical sound is emitted.

In the shot detection processing at Step S3, the CPU 11 generates a note-ON event based on the motion sensor information (such as a sensor resultant value of the acceleration sensor). The note-ON event to be generated herein may include the volume of a musical sound to be emitted, which can be determined from, for example, the maximum value of the sensor resultant value.

Next, the CPU 11 transmits information detected by the processing at Step S1 to Step S3, or in other words, the motion sensor information, the attitude information, and the shot information to the center unit section 30 via the data communication section 16 (Step S4). When transmitting, the CPU 11 associates the motion sensor information, the attitude information, and the shot information with the drumstick identification information, and then transmits them to the center unit section 30.

Then, the CPU 11 returns to the processing at Step S1 and repeats the subsequent processing.

[Processing by the Camera Unit Section 20]

Figure 9:
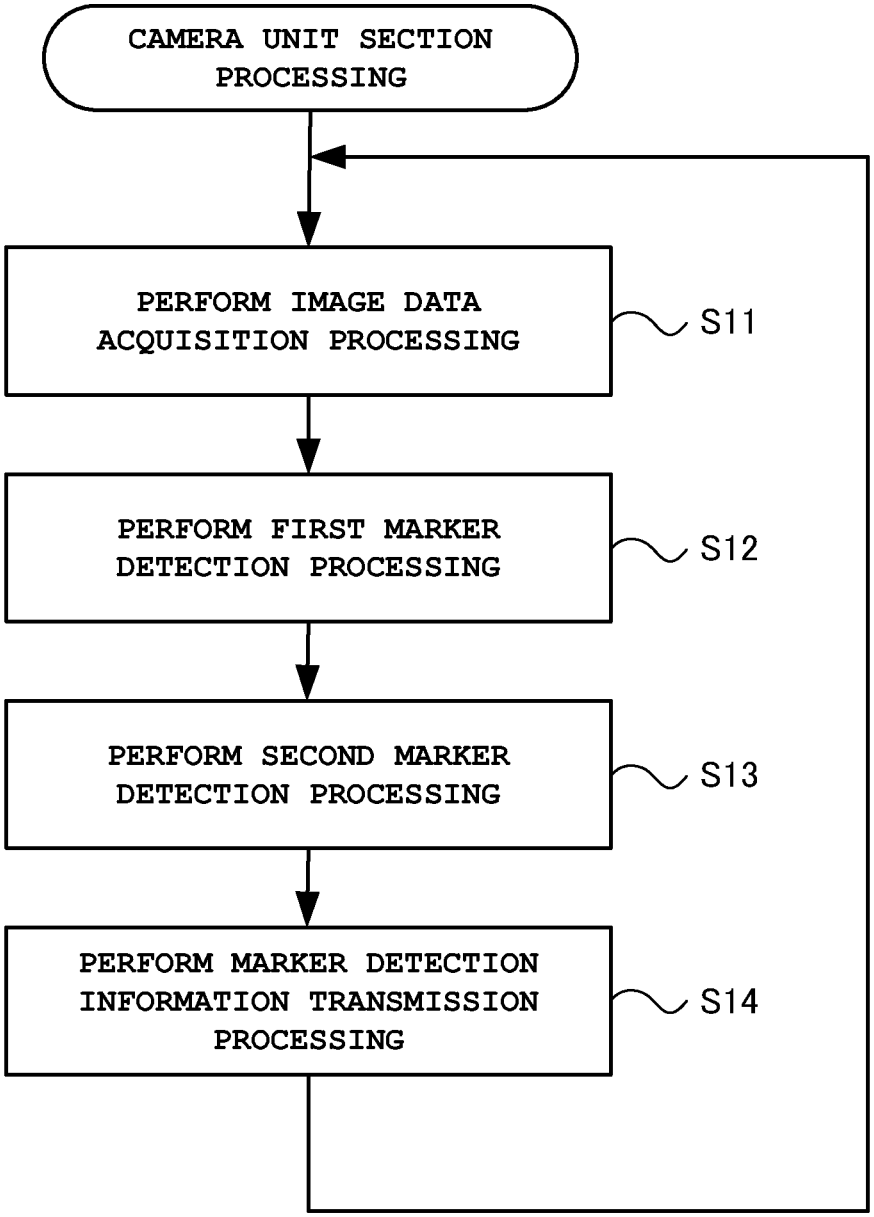
FIG. 9 is a flowchart of processing by the camera unit section.

FIG. 9 is a flowchart of processing that is performed by the camera unit section 20 (hereinafter referred to as "camera unit section processing").

As shown in FIG. 9, the CPU 21 of the camera unit section 20 first performs image data acquisition processing (Step S11). In the image data acquisition processing, the CPU 21 acquires image data from the image sensor section 24.

Next, the CPU 21 performs first marker detection processing (Step S12) and second marker detection processing (Step S13). In the first marker detection processing and the second marker detection processing, the CPU 21 acquires the marker detection information of the marker section 15 (first marker) of the drumstick section 10R and the marker detection information of the marker section 15 (second marker) of the drumstick section 10L which include the position coordinates, the sizes, and the angles thereof and have been detected by the image sensor section 24, and stores the marker detection information in the RAM 23. Note that the image sensor section 24 detects the marker detection information of the lighted marker section 15.

Then, the CPU 21 transmits the marker detection information acquired at Step S12 and Step S13 to the center unit section 30 via the data communication section 25 (Step S14), and returns to the processing at Step S11.

[Processing by the Center Unit Section 30]

Figure 10:
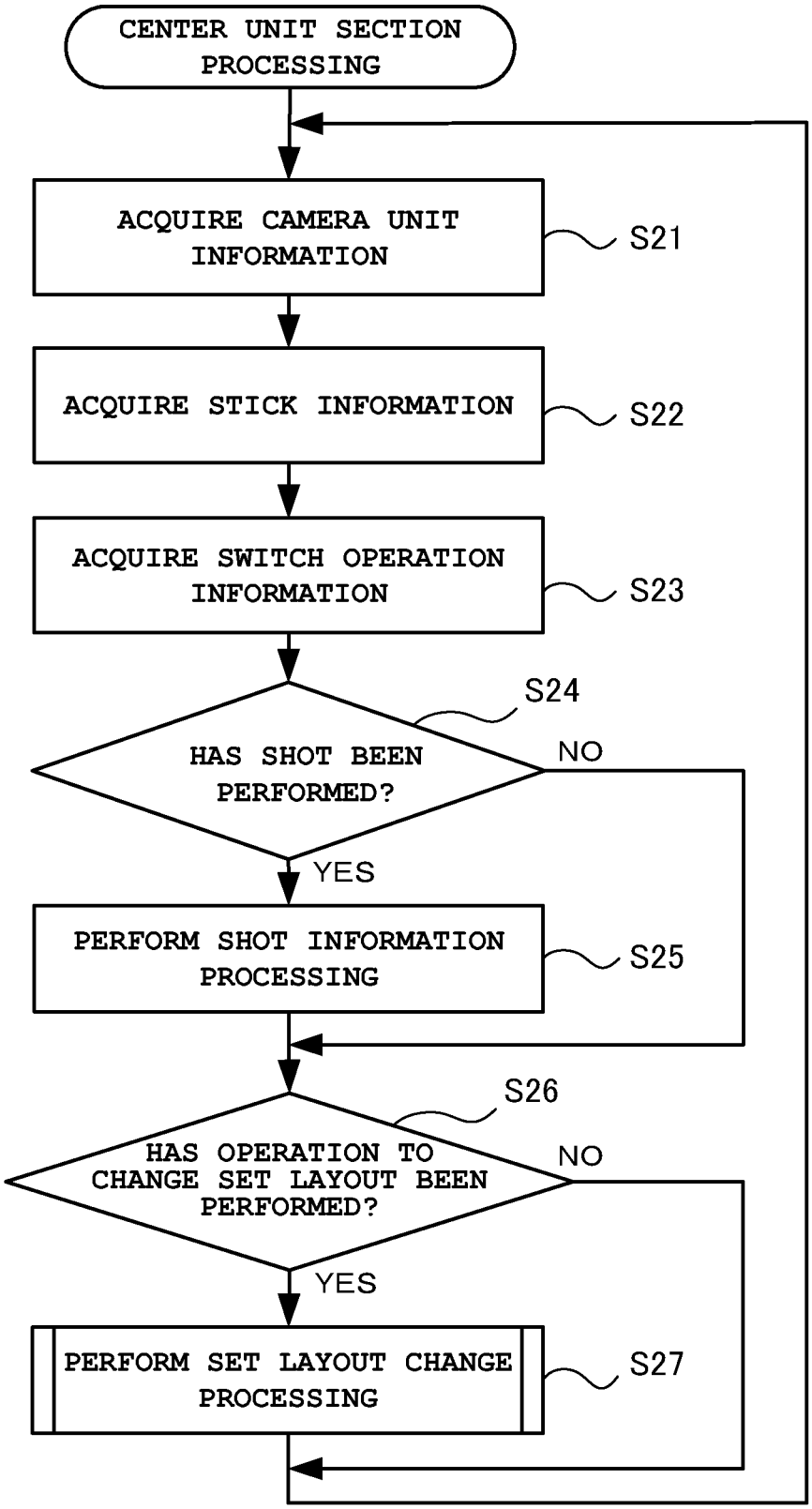
FIG. 10 is a flowchart of processing by the center unit section.

FIG. 10 is a flowchart of processing that is performed by the center unit section 30 (hereinafter referred to as "center unit section processing").

As shown in FIG. 10, the CPU 31 of the center unit section 30 first receives the marker detection information of the first maker and the second marker from the camera unit section 20, and stores them in the RAM 33 (Step S21). In addition, the CPU 31 receives motion sensor information, attitude information, and shot information associated with drumstick identification information from each of the drumstick sections 10R and 10L, and stores them in the RAM 33 (Step S22). Moreover, the CPU 31 acquires information inputted by the operation of the switch 341 (Step S23).

Next, the CPU 31 judges whether a shot has been performed (Step S24). In this processing, the CPU 31 judges whether a shot has been performed by judging whether a note-ON event has been received from the drumstick section 10. When judged that a shot has been performed, the CPU 31 performs shot information processing (Step S25). In the shot information processing, the CPU 31 reads out musical tone data (waveform data) associated with a virtual pad 81 in an area where position coordinates included in the marker detection information are located, from set layout information read out into the RAM 33, and outputs the musical tone data and sound volume data included in the note-ON event to the sound source device 36. Then, the sound source device 36 emits the corresponding musical sound based on the received waveform data. When the processing at Step S25 is completed, the CPU 31 returns to the processing at Step S21.

When a judgment result at Step S24 is NO, the CPU 31 judges whether an operation to change the current set layout has been performed (Step S26). In this processing operation, the CPU 31 judges whether the drumstick sections 10R and 10L have been held stationary for a predetermined amount of time with one of them being held upwards in the vertical direction, the other being held downwards in the vertical direction, and a square being formed whose sides are constituted by the drumstick sections 10R and 10L.

Specifically, the CPU 31 judges whether a state where an acceleration sensor value and an angular velocity sensor value in the motion sensor information acquired at Step S22 are both zero has continued for a predetermined amount of time when the attitude information acquired at Step S22 indicates that the pitch angle of one of the drumstick sections 10R and 10L is 90 degrees and the pitch angle of the other is −90 degrees, and the marker detection information acquired at Step S21 indicates that a relationship (Rx1−Lx1)=(Ry1−Ly1), in which (Rx1,Ry1) and (Lx1,Ly1) are respectively the position coordinates of the marker sections 15 of the drumstick sections 10R and 10L, has been established.

When judged an operation to change the set layout has been performed, the CPU 31 performs set layout change processing (Step S27) and then returns to the processing at Step S21. Conversely, when judged that an operation to change the set layout has not been performed, the CPU 31 returns to the processing at Step S21 without performing any processing.

Note that the virtual plane in the present embodiment is an X-Y plane, of which the lateral direction is the X-axis direction and the vertical direction is the Y-axis direction.

Also note that, when judging whether the drumstick sections 10R and 10L have been held stationary for a predetermined amount of time, the CPU 31 may judge that an operation to change the set layout has been performed, before the elapse of the predetermined amount of time, if a set layout change signal is received from the drumstick section 10 by the operation of the switch 171 of the drumstick section 10.

[Set Layout Change Processing by the Center Unit Section 30]

FIG. 11 is a flowchart showing a detailed flow of the set layout change processing at Step S27 in the center unit section processing in FIG. 10.

Figure 12:
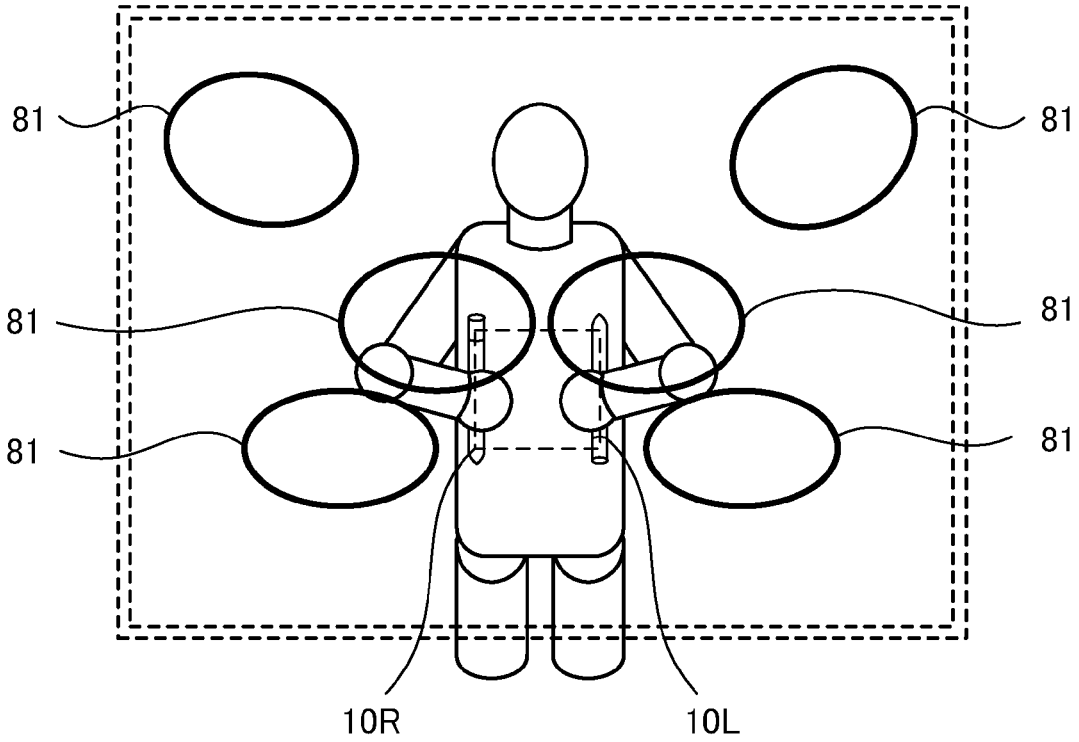
FIG. 12 is a diagram of a drumstick standard position formed by the drumstick section.

As shown in FIG. 11, the CPU 31 first calculates center coordinates and an offset value (Step S31). Here, the positions of the drumstick sections 10R and 10L corresponding to standard set layout information are referred to as "drumstick standard position" when one of the drumstick sections 10R and 10L is being held upwards in the vertical direction, the other is being held downwards in the vertical direction, and a square whose sides are constituted by the drumstick sections 10R and 10L is being formed, as necessary (see FIG. 12). Also, the positions of the drumstick sections 10R and 10L are referred to as "drumstick changed position" when the square is formed and an operation to change the current set layout is judged to have been performed at Step S26, as necessary (see FIG. 13).

Also, when the position coordinates of the marker sections 15 of the drumstick sections 10R and 10L in the drumstick standard position are (Rx0,Ry0) and (Lx0,Ly0), respectively, the center coordinates of the square formed is ((Rx0+Lx0)/2,(Ry0+Ly0)/2). These coordinates are set in advance as coordinates corresponding to the drumstick standard position.

In the processing at Step S31, specifically, the CPU 31 calculates the center coordinates ((Rx1+Lx1)/2,(Ry1+Ly1)/2) of the square from the respective position coordinates (Rx1,Ry1) and (Lx1,Ly1) of the marker sections 15 of the drumstick sections 10R and 10L detected when the CPU 31 has judged that an operation to change the current set layout has been performed at Step S26. In addition, the CPU 31 calculates the offset value ((Rx1+Lx1)/2−(Rx0+Lx0)/2,(Ry1+Ly1)/2−(Ry0+Ly0)/2) between the center coordinates of the square in the drumstick standard position and the center coordinates of the square in the drumstick changed position. This offset value serves as an offset value that is used when the respective standard positions of the plurality of virtual pads 81 in the standard set layout information are moved to positions in the changed set layout information.

Next, the CPU 31 calculates an enlargement/reduction rate (Step S32). The enlargement/reduction rate is a scale used to enlarge or reduce the respective standard sizes of the plurality of virtual pads 81 in the standard set layout information to sizes in the changed set layout information.

Specifically, the CPU 31 calculates the enlargement/reduction rate in the lateral direction (the size of (Rx1−Lx1)/(Rx0−Lx0)) and the enlargement/reduction rate in the vertical direction (the size of (Ry1−Ly1)/(Ry0−Ly0)).

Next, the CPU 31 adjusts the positions of the virtual pads 81 (Step S33). Specifically, the CPU 31 multiplies all position coordinates included in areas defined by the respective standard positions and standard sizes of the plurality of virtual pads 81 in the standard set layout information with the enlargement/reduction rates in the vertical and lateral directions calculated at Step S32, and adds the offset value calculated at Step S31 to all position coordinates after the multiplication.

Figure 13:
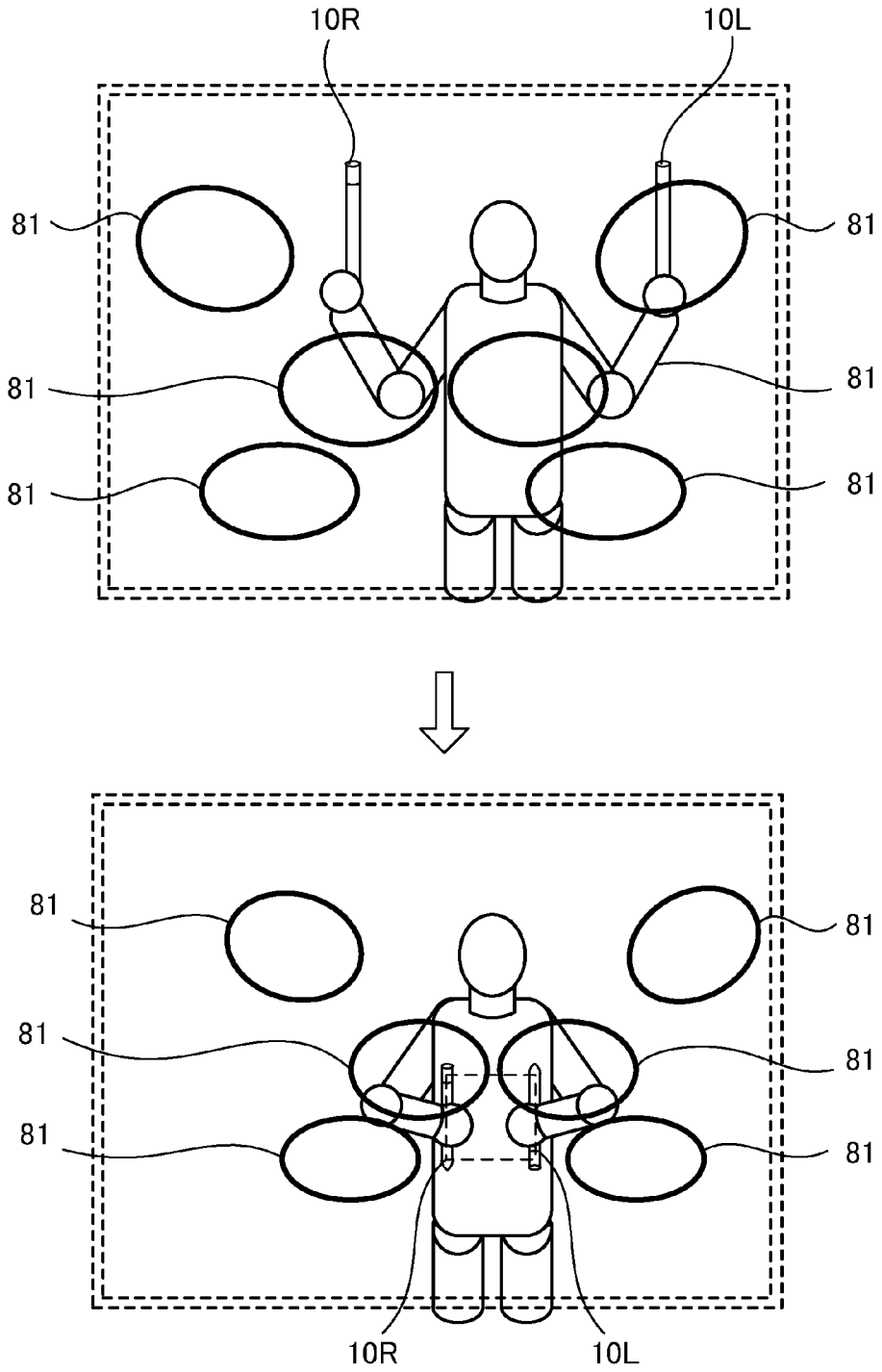
FIG. 13 is a diagram of a drumstick changed position formed by the drumstick section.

For example, when the instrument player moves in the lateral direction, the front/back direction, or both lateral and front/back directions during musical performance based on the standard set layout information and forms the square using the drumstick sections 10R and 10L, the CPU 31 uniformly changes the plurality of virtual pads 81 in the standard set layout information to be offset and reduced (or enlarged), whereby the instrument player can play based on the changed set layout information, as shown in FIG. 13.

When the processing at Step S33 is completed, the CPU 31 ends the set layout change processing.

The structure and processing of the musical performance device 1 according to the present embodiment are as described above.

In the present embodiment, set layout information includes standard set layout information that serves as reference for the arrangement of the plurality of virtual pads 81, and the CPU 31 judges whether an operation to form a square has been performed with the pair of drumstick sections 10. When judged that an operation to form a square has been performed, the CPU 31 uniformly adjusts the arrangement of the plurality of virtual pads 81 based on preset position coordinates on a captured image plane corresponding to the standard set layout information and the position coordinates of the pair of drumstick sections 10 on the captured image plane at the time of the operation to form a square.

Therefore, when the instrument player moves in relation to the camera unit section 20 and performs a predetermined operation after the movement, the arrangement of the plurality of virtual pads 81 is appropriately and uniformly changed in accordance with the position of the instrument player. As a result, the instrument player need not play in an uncomfortable position.

Also, in the set layout information of the present embodiment, the plurality of virtual pads 81 have been associated with their positions and sizes. In addition, the standard set layout information includes standard positions and standard sizes that serve as reference for the arrangement of the plurality of virtual pads 81. The CPU 31 uniformly calculates the amount of positional change from the standard positions of the plurality of virtual pads 81 and the rate of size change from the standard sizes, and adjusts the positions and sizes of the plurality of virtual pads 81 based on the calculated positional change amount and size change rate.

Therefore, when the instrument player moves forward/backward and left/right in relation to the camera unit section 20, the positions of the plurality of virtual pads 81 are appropriately moved in parallel along with the left/right movement, and the sizes thereof are appropriately enlarged or reduced along with the forward/backward movement.

Moreover, in the present embodiment, the drumstick section 10 detects the attitude information of itself, and the CPU 31 judges that an operation to form a square has been performed on condition that the attitude of the pair of drumstick sections 10 are opposite to each other in the vertical direction, and the amount of difference of the X coordinates and the amount of difference of the Y coordinates between the position coordinates of the pair of drumstick sections 10 in the camera unit section 20 are equal.

Therefore, the instrument player can easily perform an operation to form a square that serves as a trigger to adjust the positions and sizes in the set layout information.

Note that, although the above-described embodiment has been described using the virtual drum set D (see FIG. 1) as a virtual percussion instrument, the present invention is not limited thereto, and may be applied to other musical instruments such as a xylophone which emit musical sound by a downward swing movement of the drumstick section 10.

In addition, in the above-described embodiment, the adjustment of layout information is triggered by the formation of a square whose sides are constituted by the drumstick sections 10. However, the present invention is not limited thereto, and other shapes such as a parallelogram, may be formed.

While the present invention has been described with reference to the preferred embodiments, it is intended that the invention be not limited by any of the details of the description therein but includes all the embodiments which fall within the scope of the appended claims.

What is claimed is:

1. A musical performance device comprising:

a musical performance component which is operable by a player;

a position detecting section which detects a position of the musical performance component on a virtual plane where the musical performance component is operated;

a storage section which stores layout information including positions of a plurality of areas arranged on the virtual plane and musical tones respectively associated with the plurality of areas;

a predetermined operation judging section which judges whether a predetermined operation is performed with the musical performance component;

a changing section which changes the respective positions of the plurality of areas in the layout information stored in the storage section based on the position of the musical performance component at a time when the predetermined operation judging section judges that the predetermined operation is performed, such that respective positional relationships between each of the plurality of areas are maintained;

a judging section which judges whether the position of the musical performance component is within any one of the plurality of areas arranged based on the layout information stored in the storage section, when a certain music-playing operation is performed by the musical performance component; and a sound generation instructing section which, when the judging section judges that the position of the musical performance component is within one area of the plurality of areas, gives an instruction to emit a musical sound of a musical tone associated with the one area.

2. The musical performance device according to claim 1, wherein the layout information further includes information regarding respective sizes of the plurality of areas; and wherein the changing section uniformly calculates an amount of positional change with reference to the respective positions of the plurality of areas stored in the storage section and a rate of size change with reference to the respective sizes of the plurality of areas stored in the storage section, and changes the respective positions and the respective sizes of the plurality of areas stored in the storage section based on the calculated amount of positional change and the calculated rate of size change.

3. The musical performance device according to claim 1, wherein the musical performance component comprises an attitude detecting section which detects an attitude of the musical performance component; and wherein the predetermined operation judging section judges that the predetermined operation is performed when the attitude detected by the attitude detecting section is similar to a predetermined attitude, and a predetermined condition regarding the position of the musical performance component on the virtual plane is satisfied.

4. The musical performance device according to claim 2, wherein the musical performance component comprises an attitude detecting section which detects an attitude of the musical performance component; and wherein the predetermined operation judging section judges that the predetermined operation is performed when the attitude detected by the attitude detecting section is similar to a predetermined attitude, and a predetermined condition regarding the position of the musical performance component on the virtual plane is satisfied.

5. A non-transitory computer-readable storage medium having stored thereon a program that is executable by a computer used as a musical performance device including a musical performance component which is operable by an instrument player, a position detecting section which detects a position of the musical performance component on a virtual plane where the musical performance component is operated, and a storage section which stores layout information including positions of a plurality of areas arranged on the virtual plane and musical tones respectively associated with the plurality of areas, the program being executable by the computer to perform functions comprising:

judging whether a predetermined operation is performed on the musical performance component;

changing the respective positions of the plurality of areas in the layout information stored in the storage section based on the position of the musical performance component at a time when the predetermined operation is judged to be performed, such that respective positional relationships between each of the plurality of areas are maintained;

judging whether the position of the musical performance component is within any one of the plurality of areas arranged based on the layout information, when a certain music-playing operation is performed by the musical performance component; and when the position of the musical performance component is judged to be within one area of the plurality of areas, giving an instruction to emit a musical sound of a musical tone associated with the one area.

6. A method of controlling a musical performance device including a musical performance component which is operable by an instrument player, a position detecting section which detects a position of the musical performance component on a virtual plane where the musical performance component is operated, and a storage section which stores layout information including positions of a plurality of areas arranged on the virtual plane and musical tones respectively associated with the plurality of areas, the method comprising:

judging whether a predetermined operation is performed on the musical performance component;

changing the respective positions of the plurality of areas in the layout information stored in the storage section based on the position of the musical performance component at a time when the predetermined operation is judged to be performed, such that respective positional relationships between each of the plurality of areas are maintained;

judging whether the position of the musical performance component is within any one of the plurality of areas arranged based on the layout information, when a certain music-playing operation is performed by the musical performance component; and giving an instruction to, when the position of the musical performance component is judged to be within one area of the plurality of areas, emit a musical sound of a musical tone associated with the one area.

* * * * *